United States Patent [19]

Perner et al.

[11] Patent Number: 5,009,805

[45] Date of Patent: Apr. 23, 1991

[54] LIQUID DETERGENT WITH COPOLYMER ADDITIVE

[75] Inventors: Johannes Perner, Neustadt; Paul Diessel, Mutterstadt; Heinrich Hartmann, Limburgerhof; Walter Denzinger, Speyer; Alfred Oftring, Bad Duerkheim; Willibald Schoenleben, Heidelberg, all of Fed. Rep. of Germany

[73] Assignee: BASF Aktiengesellschaft, Ludwigshafen, Fed. Rep. of Germany

[21] Appl. No.: 424,084

[22] Filed: Oct. 19, 1989

[30] Foreign Application Priority Data

Nov. 10, 1988 [DE] Fed. Rep. of Germany ..... 3838093

[51] Int. Cl.[5] ..... C11D 3/37

[52] U.S. Cl. ..... 252/174.24; 252/173; 252/174.23; 252/DIG. 2; 252/DIG. 14

[58] Field of Search ..... 252/174.23, 174.24; 8/137

[56] References Cited

U.S. PATENT DOCUMENTS

| | | | |
|---|---|---|---|
| 3,328,309 | 6/1967 | Grifo et al. | 252/137 |
| 4,559,159 | 12/1985 | Denzinger et al. | 252/174.24 |
| 4,702,858 | 10/1987 | Denzinger et al. | 252/174.24 |
| 4,897,215 | 1/1990 | Trieselt et al. | 252/174.24 |
| 4,897,220 | 1/1990 | Trieselt et al. | 252/174.24 |

FOREIGN PATENT DOCUMENTS

| | | |
|---|---|---|
| 0116930 | 8/1984 | European Pat. Off. . |
| 0215251 | 3/1987 | European Pat. Off. . |
| 0237075 | 9/1987 | European Pat. Off. . |

*Primary Examiner*—Paul Lieberman
*Assistant Examiner*—A. Beadles-Hay
*Attorney, Agent, or Firm*—Oblon, Spivak, McClelland, Maier & Neustadt

[57] ABSTRACT

Liquid detergent formulations contain as essential constituents a surfactant and 0.1–20% by weight of a copolymer which contains (a) 50–99 mol % of units of a monoethylenically unsaturated $C_3$–$C_8$-monocarboxylic acid, a monoethylenically unsaturated $C_4$–$C_8$-dicarboxylic acid, a half ester of a monoethylenically unsaturated $C_4$–$C_8$-dicarboxylic acid, an ester of a monoethylenically unsaturated $C_3$–$C_8$-monocarboxylic acid, a $C_2$–$C_{30}$-olefin, styrene, a $C_1$–$C_3$-alkylstyrene, a $C_1$–$C_{28}$-alkyl vinyl ether, a vinyl ester of a saturated $C_1$–$C_8$-monocarboxylic acid or a mixture thereof and (b) 50–1 mol % of units of an amide of a monoethylenically unsaturated $C_3$–$C_8$-carboxylic acid where the amide groups have the structure

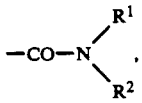

where $R^1$ is $C_8$–$C_{28}$-alkyl or preferably

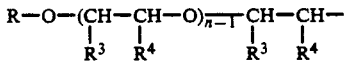

$R^3$ and $R^4$ are each H, $CH_3$ or $C_2H_5$,

R is $C_1$–$C_{28}$-alkyl, n is from 2 to 100 and $R^2$ is H or $R^1$, and has a K value of from 8 to 200, or a salt thereof.

7 Claims, No Drawings

LIQUID DETERGENT WITH COPOLYMER ADDITIVE

EP-B-0,116,930 discloses water-soluble copolymers composed of 40–90% by weight of one or more ethylenically unsaturated monocarboxylic acids of from 3 to 5 carbon atoms and 60–10% by weight of one or more ethylenically unsaturated dicarboxylic acids of from 4 to 8 carbon atoms and/or corresponding dicarboxylic anhydrides, where 2–60% by weight, based on the total weight of the carboxylic acids or anhydrides, are esterified with alkoxylated $C_1$–$C_{18}$-alcohols or $C_1$–$C_{12}$-alkylphenols. The partially esterified copolymers and their water-soluble salts are used inter alia in amounts of 0.5–10% by weight in liquid detergent formulations. The compatibility of the partially esterified copolymers of one or more monoethylenically unsaturated monocarboxylic acids and one or more monoethylenically unsaturated dicarboxylic acids is said to be significantly better than that of nonesterified products, so that there are fewer phase separations. However, partially esterified copolymers of the type described are not stable to hydrolysis; they hydrolyze in liquid detergent formulations. This causes inhomogeneities which may even lead to phase separation in the liquid detergent.

EP-A-0,237,075 discloses liquid detergents containing one or more nonionic surfactants in an amount of 5–25% by weight, 2–25% by weight of builder, about 1–10% by weight of $C_4$–$C_{30}$-$\alpha$-olefin/maleic anhydride copolymers as well as water to 100% by weight. It is true that these liquid detergents are initially clear solutions, but they separate relatively quickly on storage.

U.S. Pat. No. 3,328,309 discloses liquid alkaline detergent formulations which besides water and detergents contain 0.1–5%, based on the entire formulation, of a stabilizer comprising a hydrolyzed copolymer of $\alpha,\beta$-unsaturated carboxylic anhydride with a vinyl ester, a vinyl ether or an $\alpha$-olefin in partially esterified form. Suitable alcohol components for the esterification include addition products of alkylene oxides, in particular ethylene oxide on alkylphenols. Only 0.01–5% of carboxyl groups of the copolymer are present in the form of ester groups. It is true that these liquid detergents contain mutually compatible components, but the primary detergency of this liquid detergent formulation is still in need of improvement.

EP-A-0,215,251 discloses the use of homopolymers of acrylic acid and methacrylic acid, copolymers of acrylic acid and methacrylic acid, and copolymers of ethylenically unsaturated dicarboxylic acids of from 4 to 6 carbon atoms and acrylic or methacrylic acid, each partially neutralized and/or partially amidated with long-chain amines, in amounts of from 0.05 to 10% by weight in detergents as grayness inhibitors which improve the primary detergency. The partially amidated homopolymers and copolymers are prepared by reaction of the polymers with the long-chain amines. In many cases they still contain free amines, which, owing to their odor and physiological concerns, are undesirable in detergent formulations. The partially (long chain)amine-neutralized or -amidated polymers are used for preparing pulverulent detergents. This reference does not contain any indication that the products described therein might be used for preparing stable liquid detergents.

It is an object of the present invention to provide a polymer for the preparation of a stable liquid detergent formulation which, compared with the prior art liquid detergent formulations, shows improved primary and secondary detergency. A stable liquid detergent formulation for the purposes of the present invention is a liquid detergent formulation whose individual components are mutually compatible and do not separate, not even on prolonged storage.

We have found that this object is achieved by using a copolymer which contains as essential constituents (a) 50–99 mol % of units of a monoethylenically unsaturated $C_3$–$C_8$-monocarboxylic acid, a monoethylenically unsaturated $C_4$–$C_8$-dicarboxylic acid, a half ester of a monoethylenically unsaturated $C_4$–$C_8$-dicarboxylic acid, an ester of a monoethylenically unsaturated $C_3$–$C_8$-monocarboxylic acid, a $C_2$–$C_{30}$-olefin, styrene, a $C_1$–$C_3$-alkyl styrene, a $C_1$–$C_{28}$-alkyl vinyl ether, a vinyl ester of a saturated $C_1$–$C_8$-monocarboxylic acid or a mixture thereof and (b) 50–1 mol % of units of an amide of a monoethylenically unsaturated $C_3$–$C_8$-carboxylic acid where the amide groups have the structure

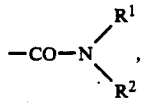

where $R^1$ is $C_8$–$C_{28}$-alkyl or

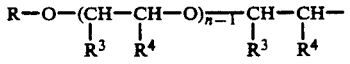

$R^3$ and $R^4$ are each H, $CH_3$ or $C_2H_5$,

R is $C_1$–$C_{28}$-alkyl, n is from 2 to 100 and $R^2$ is H or $R^1$, as copolymerized units, and has a K value of from 8 to 200 (determined by the method of H. Fikentscher in aqueous solution at 25° C., pH 7.5 and a polymer concentration of 1% by weight), or a salt thereof, as a liquid detergent additive in an amount of from 0.1 to 20% by weight.

The liquid detergent which contains the copolymer to be used according to the present invention produces on mixing with a neutral or alkaline aqueous solution of an anionic or nonionic surfactant a clear aqueous solution which is stable to storage; that is, the individual components of the liquid detergent formulation are mutually compatible and do not separate, even on prolonged storage.

The copolymer to be used according to the present invention contains as essential constituents copolymerized units of a monoethylenically unsaturated $C_3$–$C_8$-monocarboxylic acid, of a monoethylenically unsaturated $C_4$–$C_8$-dicarboxylic acid, of a half ester of a monoethylenically unsaturated $C_4$–$C_8$-dicarboxylic acid, of an ester of a monoethylenically unsaturated $C_3$–$C_8$-carboxylic acid, of a $C_2$–$C_{30}$-olefin, of styrene, of a $C_1$–$C_3$-alkyl styrene, of a $C_1$–$C_{28}$-alkyl vinyl ether, of a vinyl ester of a saturated $C_1$–$C_8$-carboxylic acid, or a mixture thereof.

The ethylenically unsaturated $C_3$–$C_8$-monocarboxylic acid may be for example acrylic acid, methacrylic acid, vinyl acetic acid, allyl acetic acid, propylidene acetic acid, ethylidene acetic acid, $\alpha$-ethylacrylic acid or $\beta,\beta$-dimethylacrylic acid. Of this group of monomers, acrylic acid and methacrylic acid are preferred. Suitable monoethylenically unsaturated $C_4$–$C_8$-dicarboxylic acids are for example maleic acid, itaconic acid, fumaric acid, mesaconic acid, methylenemalonic acid and citraconic acid. The copolymer to be used according to the present invention preferably contains maleic acid or itaconic acid as copolymerized units. It is also possible to use a half ester of a monethylenically unsaturated $C_4$–$C_8$-dicarboxylic acid derived from a monohydric or polyhydric alcohol of from 1 to 8 carbon atoms. Such alcohols are for example methanol, ethanol, n-propanol, isopropanol, n-butanol, sec-butanol, 2-ethylhexyl alcohol, glycol, 1,2-propanediol, 1,3-propanediol, 1,4-butanediol, 1,2-butanediol and 1,6-hexanediol. The alcohols mentioned may also be used for preparing esters of monoethylenically unsaturated $C_3$–$C_8$-monocarboxylic acids, which are likewise suitable for use as component (a) for preparing the copolymer to be used according to the present invention.

Such esters are for example methyl acrylate, ethyl acrylate, butyl acrylate, 2-ethylhexyl acrylate, hydroxyethyl acrylate, hydroxypropyl acrylate and the corresponding esters of methacrylic acid.

Suitable olefins of from 2 to 30 carbon atoms are for example ethylene, propylene, isobutylene, n-hexene, n-octene, diisobutene, n-decene, n-dodecene and n-octadecene. In longer-chain olefins, the double bond may be in the $\alpha$-position or else in the $\beta$-position. Particular preference is given to using $\alpha$-olefins. Preferred olefins are branched $C_6$–$C_{18}$-olefins and mixtures thereof. Particular preference is given to using a mixture of 2,4,4'-trimethyl-1-pentene and 2,4,4'-trimethyl-2-pentene. Commercial mixtures of diisobutylene contain about 80% of trimethyl-1-pentene and about 20% of trimethyl-2-pentene.

The copolymer may further contain as an essential constituent of component (a) copolymerized units of styrene or of a $C_1$–$C_3$-alkylstyrene. Suitable alkyl styrenes are for example $\alpha$-methylstyrene and $\alpha$-ethylstyrene. Another suitable component of (a) is a $C_1$–$C_{28}$-alkyl vinyl ether, e.g. methyl vinyl ether, ethyl vinyl ether, n-propyl vinyl ether, isopropyl vinyl ether, n-butyl vinyl ether, isobutyl vinyl ether, n-hexyl vinyl ether, n-octyl vinyl ether, dodecyl vinyl ether or octadecyl vinyl ether. A further suitable component (a) is a vinyl ester of a saturated $C_1$–$C_8$-carboxylic acid, e.g. vinyl formate, vinyl acetate, vinyl propionate or vinyl butyrate.

In many cases it is of particular advantage if the copolymer contains a copolymerized mixture of units of a monoethylenically unsaturated $C_4$–$C_8$-dicarboxylic acid with units of a half ester of a monoethylenically unsaturated $C_4$–$C_8$-dicarboxylic acid, an ester of a monoethylenically unsaturated $C_3$–$C_8$-monocarboxylic acid, a $C_2$–$C_{30}$-olefin, styrene, a $C_1$–$C_3$-alkylstyrene, a $C_1$–$C_{28}$-alkyl vinyl ether, a vinyl ester of a saturated $C_1$–$C_8$-monocarboxylic acid, a monoethylenically unsaturated $C_3$–$C_8$-monocarboxylic acid or salts thereof, if they exist. Preferred monoethylenically unsaturated $C_4$–$C_8$-dicarboxylic acids are maleic acid and itanonic acid. In the preferred embodiment of the invention, units of these dicarboxylic acids are present in the copolymer together with units of one or more monomers (a) other than other dicarboxylic acid monomers. The monomers of component (a) account for 50–99, preferably 60–90, mol % of the copolymer.

The copolymer contains as a further essential constituent units of an amide of a monoethylenically unsaturated $C_3$–$C_8$-carboxylic acid where the amide groups have the structure

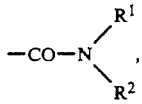

where $R^1$ is $C_8$–$C_{28}$-alkyl or

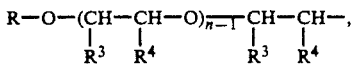

$R^3$ and $R^4$ are each H, $CH_3$ or $C_2H_5$,

R is $C_1$–$C_{28}$-alkyl, n is from 2 to 100 and $R^2$ is H or $R^1$.

The amide groups of units of compounds of component (b) preferably have the structure

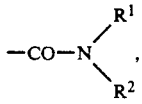

where $R^1$ is

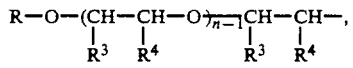

$R^3$ and $R^4$ are each H, $CH_3$ or $C_2H_5$,

R is $C_1$–$C_{28}$-alkyl, b is 2–100, preferably 4–30, and $R^2$ is H or $R^1$ as defined above.

The amides of component (b) are preferably derived from amides of acrylic acid and methacrylic acid and from mono- and diamides of maleic acid and itaconic acid having the above-indicated amide structures. The amides of component (b) of the copolymer are prepared for example by reacting a monoethylenically unsaturated $C_3$–$C_8$-carboxylic acid, or a chloride thereof, with an amine of the formula

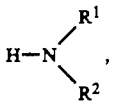

where $R^1$ and $R^2$ are each as defined above for the amide structure, to give amides, i.e. monoamides or diamides, in a conventional manner. Those amines where $R^1$ is the group

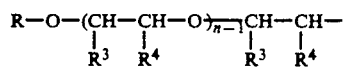

are prepared by alkoxylation of alcohols of the formula R—OH (where R is $C_1$–$C_{28}$-alkyl) with n moles of alkylene oxide per mole of alcohol and subsequent amination of the alkoxylation products. Suitable amides of ethylenically unsaturated compounds of component (b) are for example the following compounds:

| | $R^1$ | $R^2$ |
|---|---|---|
| $CH_2{=}CH{-}CO{-}N(R^1)(R^2)$ (I) | $-CH_2-CH(CH_3)-(CH_2)_7-CH_3$ | H |
| I | $-(CH_2)_{11}-CH_3$ | H |
| I | $-(CH_2)_{17}-CH_3$ | H |
| I | $-C_8H_{17}$ | $-C_8H_{17}$ |
| $CH_2{=}C(CH_3){-}CO{-}N(R^1)(R^2)$ (II) | $-(CH_2)_{15}-CH_3$ | H |
| $CH{-}COOH \parallel CH{-}CO{-}N(R^1)(R^2)$ (III) | $-(CH_2)_{11}-CH_3$ | H |
| III | $-(CH_2)_{17}-CH_3$ | H |
| I | $C_{12}/C_{14}$-Alkyl-O$-(CH_2-CH_2-O)_7-CH_2-CH_2-$ | H |
| I | $C_{13}/C_{15}$-Alkyl-O$-(CH_2-CH_2-O)_6-CH_2-CH_2-$ | H |
| I | $C_{13}/C_{15}$-Alkyl-O$-(CH_2-CH_2-O)_{29}-CH_2-CH_2-$ | H |
| I | $C_{16}/C_{18}$-Alkyl-O$-(CH_2-CH_2-O)_{79}-CH_2-CH_2-$ | H |
| III | $C_{13}/C_{15}$-Alkyl-O$-(CH_2-CH_2-O)_6-CH_2-CH_2-$ | H |
| III | $C_{13}$-Alkyl-O$-(CH_2-CH_2-O)_7-CH_2-CH_2-$ | H |
| $CH{-}CO{-}N(R^1)(R^2) \parallel CH{-}CO{-}N(R^1)(R^2)$ (IV) | $C_{13}/C_{15}$-Alkyl-O$-(CH_2-CH_2-O)_6-CH_2-CH_2-$ | H |
| III | $C_{13}/C_{15}$-Alkyl-O$-(CH_2-CH_2-O)_{12}-(CH_2-CH(CH_3)-O)_5CH_2-CH(CH_3)-$ | H |
| $CH_2{=}C(COOH){-}CH_2{-}CO{-}N(R^1)(R^2)$ (V) | $C_{16}/C_{18}$-Alkyl-O$-(CH_2-CH(CH_3)-O)_2-(CH_2-CH_2-O)_5-CH_2-CH_2-$ | H |
| III | $C_{10}$-Alkyl-O$-(CH_2-CH(C_2H_5)-O)_1-(CH_2-CH_2-O)_8-CH_2-CH(CH_3)-$ | H |

The monomers of component (b) account for 50–1, preferably 40–10, mol % of the copolymer. The copolymer is obtainable by copolymerizing the monomers indicated under (a) and (b) in a conventional manner by the technique of mass, solution, precipitation or suspension polymerization using initiators which decompose into free radicals under the polymerization conditions. The polymerization temperatures are within the range from 30 to 200° C. At the high end of the temperature range a short polymerization time is required, whereas at the low end of the temperature range the polymerization takes a comparatively long time. In a preferred embodiment of the copolymerization, (a) a mixture of an anhydride of a monoethylenically unsaturated $C_4$–$C_8$-dicarboxylic acid, in particular maleic anhydride or itaconic anhydride, is subjected to copolymerization with a $C_2$–$C_{30}$-olefin, a half ester of a monoethylenically unsaturated $C_4$–$C_8$-dicarboxylic acid, an ester of a monoethylenically unsaturated $C_3$–$C_8$-monocarboxylic acid, styrene, a $C_1$–$C_3$-alkylstyrene, a $C_1$–$C_{28}$-alkyl vinyl ether, a vinyl ester of a saturated $C_1$–$C_8$-monocarboxylic acid, a monoethylenically unsaturated $C_3$–$C_8$-monocarboxylic acid, or salts thereof, together with a compound of component (b) in an inert organic solvent in the presence of a polymerization initiator and the anhydride groups of the copolymer thus obtainable are hydrolyzed after the polymerization has ended. Suitable inert organic solvents are for example toluene, o-xylene, p-xylene, m-xylene, isopropylbenzene, tetralin, tetrahydrofuran, dioxane and aliphatic hydrocarbons, such as hexane, cyclohexane, n-heptane, n-octane or isooctane, and mixtures thereof.

Component (b) is preferably a monoamide or diamide of maleic or itaconic acid or an amide of acrylic or methacrylic acid, where each amide group has a structure of the formula

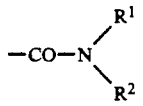

where $R^1$ is

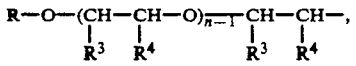

$R^3$ and $R^4$ are each H, $CH_3$ or $C_2H_5$,

R is $C_1$–$C_{28}$-alkyl, n is 2–100, preferably 4–30, and $R^2$ is H or $R^1$ as defined above.

Of particular technical interest here is the copolymer obtainable by copolymerizing the following monomer mixtures of component (a):

(1) a branched $C_6$–$C_{16}$-olefin, in particular diisobutylene, with maleic anhydride, (2) a $C_1$–$C_{28}$-alkyl vinyl ether with maleic anhydride and (3) vinyl acetate or propionate with maleic anhydride, together with one or more compounds of component (b). If the copolymerization is carried out in an inert organic solvent or else in an excess of one of the monomers as diluent, the initial copolymerization product still contains anhydride groups. The anhyride groups of a copolymer may either be hydrolyzed in an aqueous medium or else be esterified by reaction with reaction products formed by reacting (A) a $C_1$–$C_{30}$-alcohol, a $C_8$–$C_{22}$-fatty acid, a $C_1$–$C_{12}$-alkylphenol, a secondary $C_2$–$C_{30}$-amine or a mixture thereof with (B) one or more $C_2$–$C_4$-alkylene oxides or tetrahydrofuran in a molar ratio of (A):(B) of from 1:2 to 1:50.

The esterification is preferably only carried on until about 5–50% of the carboxyl groups formed from the anhydride groups on hydrolysis are esterified. Copolymers of this type, partially esterified for example with an addition product of 10 moles of ethylene oxide to 1 mole of a $C_{13}/C_{15}$-oxo alcohol, are particularly stable in alkaline aqueous liquid detergent formulations.

Other preferred copolymers, preferably prepared in aqueous solution, are obtained by copolymerizing (a) $C_3$–$C_8$-monoethylenically unsaturated carboxylic acids, monoethylenically unsaturated $C_4$–$C_8$-dicarboxylic acids or vinyl esters of saturated $C_1$–$C_8$-carboxylic acids with the compounds of component (b) in aqueous solution in the presence of polymerization initiators. Particular preference is given here to the preparation of copolymers of (a1) maleic acid and/or itaconic acid, (a2) acrylic acid and/or methacrylic acid and (b) the amides of acrylic acid and methacrylic acid and mono- and diamides of maleic acid and itaconic acid, where one or more substituents on the amide structure of compounds (b) are derived from an ethoxylation product of a $C_1$–$C_{18}$-alcohol with 4–30 ethylene oxide units.

In the simplest case, the terpolymer in question here is a terpolymer, for example of (al) maleic acid, (a2) acrylic acid and an amide (b), which, like the other copolymers not specifically mentioned, may contain (al) and (a2) as copolymerized units in any desired ratio as long as the total amount of (a1) and (a2) accounts for 50–99 mol % of the copolymer.

The radicals $R^1$ and $R^2$ of the amide structures of compounds of the formula (b) are preferably derived, as mentioned, from alkoxylated $C_1$–$C_{28}$-alcohols. These alchols may be alkoxylated with ethylene oxide alone with a mixture of ethylene oxide and propylene oxide, with or without butylene oxides, or else by block copolymerization by first adding propylene oxide and then ethylene oxide, or vice versa, i.e. first ethylene oxide and then propylene oxide, to the alcohol. In the two block copolymers described, the end group can be a butylene oxide group. The amides to be used according to (b) generally contain a sufficient number of ethylene oxide units as to ensure that these monomers are water-soluble.

The copolymer, which contains as essential units one or more monomers of groups (a) and (b) as copolymerized units, may contain further ethylenically unsaturated monomers which are different from (a) and (b) and water-soluble as copolymerized units. Such monomers are for example acrylamide, methacrylamide, acrylonitrile, methacrylonitrile, vinylsulfonic acid, allylsulfonic acid, methallylsulfonic acid, 2-acrylamidomethylpropanesulfonic acid, N-vinylpyrrolidone, N-vinylcaprolactam, N-vinylformamide, vinylphosphonic acid, N-vinylimidazole, N-vinyl-2-methylimidazoline, dimethylaminoethyl acrylate, diethylaminoethyl acrylate, dimethylaminoethyl methacrylate, diethylaminoethyl methacrylate and mixtures thereof. The basic monomers are preferably used in the form of salts or in quaternized form. Those monomers which have acid groups may also be polymerized in partially or completely neutralized form. If these monomers are included in the preparation of the copolymer to be used according to the present invention, they are present in the copolymerization in amounts of from 1 to 20% by weight, based on monomers (a) and (b).

The copolymerization may be carried out in the presence of customary regulators, e.g. thio and mercapto compounds, such as mercaptoethanol, mercaptopropanol, mercaptobutanol, mercaptoacetic acid, mercaptopropionic acid, thiolactic acid, n-butylmercaptan, tert-butylmercaptan, octylmercaptan or dodecylmercaptan. Further suitable regulators are aldehydes, such as aectaldehyde, butyraldehyde, acrolein and methacrolein, allyl compounds, e.g. allyl alcohol, n-butenol or methylbutenol, formic acid, and hydroxylamine in the form of salts, for example in the form of the sulfate or chloride. The regulator, if any is included in the polymerization, is present in an amount of from 0.01 to 20, preferably from 0.05 to 10, % by weight, based on the monomers used.

The polymerization may also be carried out in the presence of chain extenders. They bring about an increase in the molecular weight of the polymer. Chain extenders contain 2 or more ethylenically unsaturated double bonds which are not conjugated. Suitable chain extenders of this kind are for example diacrylates or dimethacrylates of not less than dihydric saturated alcohols, e.g. ethylene glycol diacrylate, ethylene glycol dimethacrylate, 1,2-propylene glycol diacrylate, 1,2-propylene glycol dimethacrylate, 1,4-butanediol diacrylate, 1,4-butanediol dimethacrylate, hexanediol diacrylate, hexanediol dimethacrylate, neopentylglycol diacrylate, neopentylglycol dimethacrylate, 3-methylpentanediol diacrylate and 3-methylpentanediol dimethacrylate. It is also possible to use acrylic and methacrylic esters of alcohols having more than 2 hydroxyl groups as chain extenders, e.g. trimethylpropane triacrylate or trimethylolpropane trimethacrylate. A further class of chain extenders are diacrylates and dimethacrylates of polyethylene glycols or polypropylene glycols having molecular weights which are preferably within the range of 400 to 2,000 in each case. Aside from the diacrylates and dimethacrylates of the homopolymers of ethylene dioxide and propylene dioxide, it is also possible to use block copolymers of ethylene oxide and propylene oxide, which are each esterified in the $\alpha,\omega$-position with acrylic acid, methacrylic or maleic acid. Chain extenders of this kind are for example diethylene glycol diacrylate, diethylene glycol dimethacrylate, triethylene glycol diacrylate, triethylene glycol dimethacrylate, tetraethylene glycol diacrylate, tetraethylene glycol dimethacrylate and the diacrylates or dimethacrylates of polyethylene glycol having a molecular weight of 1,500. Suitable chain extenders also include vinyl esters of ethylenically unsaturated $C_3$–$C_6$-carboxylic acids, e.g. vinyl acrylate, vinyl methacrylate or vinyl itaconate. It is also possible to use vinyl esters of not less than dibasic saturated carboxylic acids and di- and polyvinyl ethers of not less than dihydric alcohols, e.g. divinyl adipate, butanediol divinyl ether or trimethylolpropane trivinyl ether. Further chain extenders are allyl esters of ethylenically unsaturated carboxylic acids, e.g. allyl acrylate and allyl methacrylate, allyl ethers of polyhydric alcohols, e.g. pentaerythritol triallyl ether, triallyl sucrose and pentaallyl sucrose. It is also possible to use methylenebisacrylamide, methylenebismethacrylamide, N-divinylethyleneurea, divinylbenzene, divinyldioxane, tetraallyl silane and tetravinyl silane as chain extenders. If the copolymerization of monomers (a) and (b) is carried out in the presence of a chain extender, it is used in an amount of from 0.01 to 20, preferably from 0.05 to 10, % by weight.

Regulators and chain extenders may also be used together in the copolymerization if polymers having special properties are to be prepared. The copolymers obtained in this way have K values of from 8 to 200, preferably from 10 to 80 (determined by the method of H. Fikentscher in a one-percent aqueous solution at 25° C. and at pH 7.5 in the form of the sodium salt). The K values correspond to weight average molecular weights of from about 500–500,000, preferably 1,000–150,000. The copolymer composition must always be such that the copolymer be soluble or dispersible in water in the form of the free acid or at least in the form of a salt.

The copolymer to be used according to the present invention may also be prepared by first copolymerizing one or more monomers from the group (a3) $C_3$–$C_8$-monocarboxylic acids, half esters of monoethylenically unsaturated $C_4$–$C_8$-dicarboxylic acids, esters of monoethylenically unsaturated $C_3$–$C_8$-monocarboxylic acids, $C_2$–$C_{30}$-olefins, styrene, $C_1$–$C_3$-alkyl styrenes, $C_1$–$C_{28}$-alkyl vinyl ethers, vinyl esters of saturated $C_1$–$C_8$-carboxylic acids and mixtures thereof with (a4) an anhydride of a $C_4$–$C_8$-dicarboxylic acid, a $C_4$–$C_8$-dicarboxylic acid or an alkali metal or ammonium salt thereof, and then amidating the copolymer with an amine of the formula

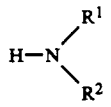

where $R^1$ is $C_8$–$C_{28}$-alkyl or

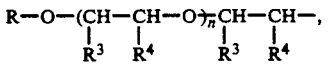

$R^3$ and $R^4$ are each H, $CH_3$, or $C_2H_5$, n is 2–100 and $R^2$ is H or $R^1$, to such an extent that the copolymer has from 50 and 1 mol % of units of an amide of a monoethylenically unsaturated $C_3$–$C_8$-carboxylic acid corresponding to the units of group (b). Preference is given to amidating copolymers which contain copolymerized units of (a3) acrylic acid or methacrylic acid and (a4) maleic acid or itaconic acid in any desired ratio, with an amine of the formula

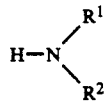

where $R^1$ is

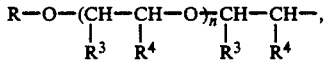

$R^3$ and $R^4$ are each H or $CH_3$,

R is $C_1$–$C_{28}$-alkyl, n is 2–100 and $R^2$ is H or $R^1$.

Such an amidated copolymer is particularly stable in aqueous liquid detergents, and shows high primary and secondary detergency. However, it is necessary that unconverted amine left over from the amidation be removed before use in liquid detergents. This can be done for example by reprecipitating the copolymer or by treating a copolymer solution with an acidic ion exchanger material.

The copolymer to be used according to the present invention can be present in the form of the free acid or in a partially or completely neutralized form, and may be added to the liquid detergent in either of these forms. If the copolymer to be used according to the present invention is to be neutralized, this is preferably done with sodium hydroxide solution, potassium hydroxide solution, ammonia or an alkanolamine, e.g. ethanolamine, diethanolamine or triethanolamine, or a mixture thereof. A copolymer which contains monomers (a) and (b) as copolymerized units is at least in salt form water-soluble or -dispersible.

The liquid detergent formulation which contains the above-described partially esterified copolymer in an amount of from 0.1–20, preferably 1–10% by weight, is usually alkaline and contains as a further essential constituent one or more anionic surfactants, one or more nonionic surfactants, or a mixture thereof, as well as water. The formulation in question here is a clear aqueous solution. Suitable anionic surfactants are for example sodium alkylbenzenesulfonates, fatty alcohol sulfates and fatty alcohol polyglycol ether sulfates. Individual compounds of this kind are for example $C_8$–$C_{12}$-alkylbenzenesulfonates, $C_{12}$–$C_{16}$-alkanesulfonates, $C_{12}$–$C_{16}$-alkyl sulfates, $C_{12}$–$C_{16}$-alkyl sulfosuccinates and sulfated ethoxylated $C_{12}$–$C_{16}$-alkanols. Suitable anionic surfactants also include sulfated fatty acid alkanolamines, fatty acid monoglycerides or reaction products of from 1 to 4 moles of ethylene oxide with primary or secondary fatty alcohols or alkylphenols. Other suitable anionic surfactants are fatty acid esters or amides of hydroxy- or amino-carboxylic or -sulfonic acids, for example fatty acid sarcosides, glycolates, lactates, taurides or isethionates. The anionic surfactants may be present in the form of the sodium, potassium and ammonium salts and as soluble salts of organic bases, such as monoethanolamine, diethanolamine or triethanolamine or of other substituted amines. The anionic surfactants also include the soaps, i.e. the alkali metal salts of natural fatty acids.

Usable nonionic surfactants, or nonionics for short, are for example addition products of from 3 to 40, preferably from 4 to 20, moles of ethylene oxide to 1 mole of fatty alcohol, alkylphenol, fatty acid, fatty amine, fatty acid amide or alkanesulfonamide. Of particular importance are the addition products of from 5 to 16 moles of ethylene oxide to coconut or tallow fatty alcohol, to oleyl alcohol or to synthetic alcohols of from 8 to 18, preferably from 12 to 18, carbon atoms, and also to mono- or dialkylphenols having from 6 to 14 carbon atoms in the alkyl moieties. However, besides these water-soluble nonionics it is also possible to use water-insoluble or partially water-soluble polyglycol ethers having from 1 to 4 ethylene glycol ether moieties in the molecule, in particular if used together with water-soluble nonionics or anionics.

Other useful nonionic surfactants are the water-soluble addition products of ethylene oxide to a polypropylene glycol ether, an alkylenediaminopolypropyl-ene glycol or an alkylpolypropylene glycol having from 1 to 10 carbon atoms in the alkyl chain which contain from 20 to 250 ethylene glycol ether groups and from 10 to 100 propylene glycol ether groups and in which the polypropylene glycol ether chain acts as a hydrophobic moiety.

It is also possible to use nonionic surfactants of the type of the amine oxides or sulfoxides.

The foaming power of a surfactant can be increased or reduced by combining suitable surfactant types. A reduction is likewise possible by adding non-surfactant-like organic substances.

The liquid aqueous detergent contains from 10 to 50% by weight of surfactant. This may be an anionic or nonionic surfactant. However, it is also possible to use a mixture of an anionic and a nonionic surfactant. In such a case, the level of anionic surfactant in the liquid detergent is selected within the range from 10 to 30% by weight and the level of nonionic surfactant in the liquid detergent is selected in the range from 5 to 20% by weight, based on the total detergent formulation.

The liquid detergent contains as an essential component the partially esterified copolymer to be used according to the present invention, in an amount of from 0.1 to 20, preferably from 1 to 10, % by weight, as well as water in amounts of from 10 to 60, preferably from 20 to 50, % by weight.

The liquid detergent may also contain further, modifying ingredients. They include for example alcohols, such as ethanol, n-propanol or isopropanol. These compounds, if they are used at all, are used in amounts of from 3 to 8% by weight, based on the total detergent formulation. The liquid detergent may also contain hydrotropes. These are compounds such as 1,2-propanediol, cumenesulfonate and toluenesulfonate. If such compounds are used for modifying the liquid detergent, their amount, based on the total weight of the liquid detergent, is from 2 to 5% by weight. In many cases, the addition of a complexing agent modifier has also proved advantageous. Complexing agents are for example ethylenediaminetetraacetic acid, nitrilotriacetate and isoserinediacetic acid and also phosphonates, such as aminotrismethylenephosphonic acid, hydroxyethanediphosphonic acid, ethylenediaminetetraethylenephosphonic acid and salts thereof. Complexing agents are used in amounts of 0 to 10% by weight, based on the liquid detergent. The liquid detergent may also contain citrates, di- or triethanolamine, turbidifiers, fluorescent whitening agents, enzymes, perfume oils and dyes. These modifying ingredients, if used at all, are present in amounts of up to 5% by weight. The liquid detergent according to the present invention is preferably phosphate-free. However, it may also contain phosphates, e.g. pentasodium triphosphate and/or tetrapotassium pyrophosphate. If phosphates are used, the phosphate content of the total formulation of the liquid detergent is from. 10 to 25% by weight.

The above-described liquid detergent has the advantage over pulverulent detergents of being easily meterable and of showing very good grease and oil dissolving power at lower wash temperatures. Liquid detergent compositions contain large amounts of active detergent substances which remove the soil from the textile fabric at wash temperatures as low as 40–60° C. The dispersing properties of polymers have hitherto not been utilizable in aqueous liquid detergents since, as a consequence of the high electrolyte concentrations in the detergents, it has been impossible to obtain stable solutions with polymers. Using the partially esterified copolymer according to the present invention it has now become possible to prepare stable aqueous solutions of detergents and to obtain a significant improvement in the wash properties of the liquid detergents. The effectiveness in a liquid detergent of the partially esterified copolymer to be used according to the present invention is demonstrated in the Examples by the stability of the liquid detergent and by primary and secondary detergency performance. Primary detergency is a measure of the ability of a detergent to remove soil from a textile material. Soil removal in turn is measured as the difference in whiteness between the unwashed and the washed textile material after a wash. The textile material used is a cotton, cotton/polyester or polyester fabric with standard soiling. After every wash the whiteness of the fabric is determined as % reflectance in an Elrepho photometer from Zeiss.

Secondary detergency is a measure of the ability of a detergent to prevent redeposition of the dislodged soil on the fabric in the wash liquor. A lack of secondary detergency only becomes noticeable after several washes, e.g. 3, 5, 10 or even only after 20, washes as increasing grayness, i.e. the redeposition of soil from the wash liquor on the fabric. To determine the grayness tendency, standard soiled fabrics are repeatedly washed together with a white test fabric with the soiled fabric being renewed after every wash. The soil dislodged from the soiled fabric and deposited on the white test fabric in the course of the wash causes a measurable drop in whiteness. The copolymer, or a water-soluble salt thereof, to be used according to the invention in a liquid detergent can also be used for formulating pulverulent detergent compositions.

The percentages in the Examples are percent by weight. The K values were determined by the method of H. Fikentscher, Cellulose Chemie 13 (1932), 58–64, 71–74. The K values of the copolymers were determined in aqueous solution at 25° C., a pH of 7.5 and a concentration of 1% by weight of the Na salts of the copolymers.

Preparation of copolymer

COPOLYMER 1

In a polymerization reactor equipped with a stirrer, a thermometer, a condensr, a nitrogen inlet, a nitrogen outlet and a metering means, 370 g of xylene, 30 g of maleic anhydride and 36 g of polyethyl vinyl ether of K 50 (measured in one percent strength in cyclohexanone at 25° C.) are heated to 80° C. in a slow stream of nitrogen. As soon as a temperature of 80° C. is reached, the reactor contents are admixed, by stirring, with a solution of 24 g of maleic anhydride in 41 g of xylene, added in the course of 2 hours, a solution of 108 g of acrylic acid and 18 g of N-(1-methyl-1-undecyl)acrylamide in 81 g of xylene, added separately over 3 hours, and a solution of 1.44 g of tert-butyl perethylhexanoate in 38.5 g of xylene, likewise added separately over 4 hours. After the initiator has been added, the reaction mixture is brought to the boil at 135° C. A solution of 1.44 g of di-tert-butyl peroxide in 8.56 g of xylene is then added over an hour, the reaction mixture is subsequently gently refluxed for a further hour and thereafter cooled down to 90° C., 100 g of water are added to hydrolyze the anhydride groups, and steam is passed in to remove the toluene as an azeotropic mixture with water until the reactor contents are at 100° C. After cooling, the copolymer is present as a yellowish, almost clear aqueous solution having a solids content of 39%. After neutralizing with sodium hydroxide solution at pH 7.5, the copolymer has a K value of 44.

COPOLYMER 2

The above preparation of copolymer 1 is repeated, except that the N-(1-methyl-1-undecyl)acrylamide is replaced by N-octadecylacrylamide. Since the viscosity of the reaction mixture increases substantially in the course of the steam distillation, 600 g of water are added. The yellowish copolymer solution thus obtained has a solids content of 11%. The K value of the sodium salt of the copolymer at pH 7.5 is 48.

COPOLYMER 3

The above-described polymerization rector is charged with 75 g of xylene, 13.5 g of maleic anhydride and 0.09 g of a polyethyl vinyl ether of K 50 (measured in one percent strength in cyclohexanone at 25° C.) as protective colloid, and the contents are heated to 80° C. in a slow stream of nitrogen. As soon as a temperature of 80° C. is reached, a solution of 22.5 g of acrylic acid and 9 g of the methacrylamide of the formula

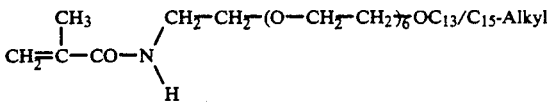

(VI)

in xylene and a solution of 0.45 g of tert-butyl perethylhexanoate in 29.55 g of xylene are added at a uniform rate at 80° C. over 3 hours and 4 hours respectively. The reaction mixture is then brought to the boil at 135° C. and is admixed with a solution of 0.225 g of ditert-butyl peroxide in 9.775 g of xylene added over one hour. After the peroxide has been added, the reaction mixture is subsequently polymerized at 135° C. for one hour and then cooled down to room temperature, and the copolymers isolated from the thin suspension by filtration and drying. It is dried at 65° C. under reduced pressure. The K value of the copolymer after neutralization with sodium hydroxide solution at pH 7.5 is 54.

COPOLYMER 4

The preparation of copolymer 3 is repeated, so that the methacrylamide derivative is replaced by the same amount of the acrylamide derivatives of the formula

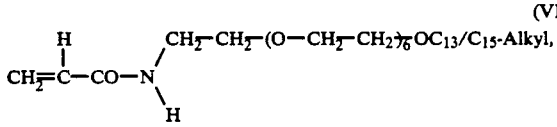

(VII)

affording a copolymer having in the form of the sodium salt at pH 7.5 a K value of 51.

COPOLYMER 5

In the above-described polymerization reactor, 300 g of xylene, 100 g of maleic anhydride, 100 g of the monomaleimide of the formula

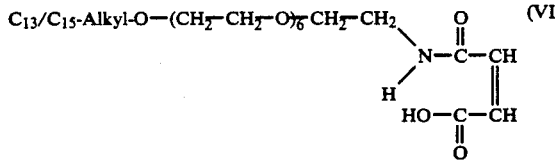

(VIII)

and 0.2 g of a polyethyl vinyl ether of K 50 (measured in one percent strength in cyclohexanone at 25° C.) are heated to 80° C. in a slow stream of nitrogen. As soon as 80° C. is reached, a solution of 300 g of acrylic acid in 80 g of xylene and a solution of 15 g of tert-butyl perethylhexanoate are metered in at a uniform rate, the latter solution over 5 hours. The mixture is then brought to the boil at about 135° C. and is admixed with a solution of 15 g of tert-butyl perethylhexanoate in 85 g of xylene added over an hour. The reaction mixture is subsequently maintained at 135° C. for a further hour and thereafter cooled down, and the copolymer is isolated from the suspension by filtration and subsequent drying at 65° C. under reduced pressure. The copolymer is soluble in water and can be neutralized with sodium hydroxide solution. The K value of the sodium salt is 29.

COPOLYMER 6

The preparation of copolymer 5 is repeated using as component (b) the copolymer of the compound of the formula

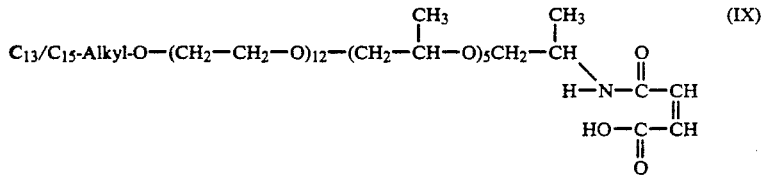

(IX)

The copolymer thus obtainable has a K value in the form of the sodium salt of 37.

COPOLYMER 7

The above-described polymerization reactor is charged with 193 g of water, 156.73 g of maleic anhyride, 46.38 g of the monomaleimide of the formula

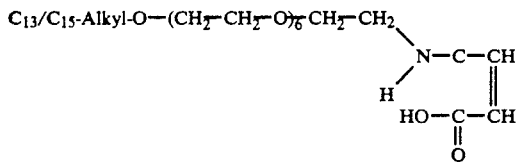

(X)

and 245.5 g of a 50% strength sodium hydroxide solution, and the contents are heated to 100° C. under superatmospheric pressure. A solution of 231.88 g of acrylic acid in 269.12 g of water and a solution of 4.65 g of sodium persulfate and 15.5 g of 30% strength hydrogen peroxide in 100 g of water are added over 5 and 6 hours respectively. The reaction mixture is subsequently maintained at 100° C. for a further 2 hours and then cooled down to 60° C. and brought to pH 7 with 25% strength aqueous sodium hydroxide solution. The solids content of the almost clear colorless polymer solution is 35%, and the K value is 76.

COPOLYMER 8

In the above-described polymerization reactor, 450 g of maleic anhydride, 150 g of a comonomer (b) of the formula

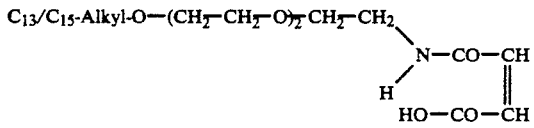

(XI)

and 333 g of o-xylene are brought to the boil at about 140° C. As soon as the solution starts to boil, a solution of 75 g of tert-butyl perethylhexanoate in 125 g of o-xylene is added over 5 hours. Thereafter the reaction mixture is heated at 140° C. for a further 2 hours. It is cooled down to 90° C., 500 g of water added over about 1 hour, and the o-xylene is distilled off with water as an azeotropic mixture until the internal temperature of the reactor is at 100° C. Sufficient 50% strength aqueous sodium hydroxide solution is then gradually added until the pH of the solution is 7. The slightly brownish solution has a solids content of 60, and a K value of the copolymer is 10 (measured at pH 7.5).

COPOLYMERS 9 to 12

In the above-described reactor, 750 g of xylene, 4.29 g of a polyethyl vinyl ether of K 50 (measured in one percent strength in cyclohexanone) and 375 g of maleic anhydride are heated in a stream of nitrogen. As soon as 80° C. is reached, a solution of 300 g of maleic anhydride in 300 g of xylene, 825 g of acrylic acid, and a solution of 12 g of tert-butyl perethylhexanoate in 300 g of xylene are added at a uniform rate over 2 hours, 3 hours and 4 hours respectively. Thereafter the reaction mixture is brought to the boil at 135° C. and is admixed with a solution of 12 g of di-tert-butyl peroxide in 150 g of xylene added over 1 hour. The reaction mixture is subsequently polymerized at 135° C. for 1 hour and then cooled down. 300 g of the yellow viscous suspension thus obtained are reacted with the amines described in the table below at 70° C. for 2.5 hours. 95 g of water are then added, and the xylene is removed by introduction of steam.

The amines indicated in Table 1 are prepared by alkoxylating a $C_{13}/C_{15}$-alcohol and then aminating the reaction product.

Table 1 shows for each case the amount of amine and the K value of the sodium salt of the copolymer. The aqueous copolymer solutions were each treated with an acidic ion exchange material to remove free, unconverted amine. They were then adjusted to a pH of approximately 7 with 50% strength aqueous sodium hydroxide solution.

TABLE 1

| Copolymer | Amine | Amount of amine [g] | K value of copolymer at pH 7.5 |
|---|---|---|---|
| 9 | $C_{13}/C_{15}$-Alkyl-O—$(CH_2—CH_2—O)_6$—$CH_2—CH_2—NH_2$ (XII) | 65.65 | 53 |
| 10 | XII | 131.35 | 44 |
| 11 | $C_{13}/C_{15}$-Alkyl-O—$(CH_2—CH_2—O)_{12}$—$(CH_2—CH(CH_3)—O)_5—CH_2—CH(CH_3)—NH_2$ (XIII) | 77.24 | 52 |

TABLE 1-continued

| Copolymer | Amine | Amount of amine [g] | K value of copolymer at pH 7.5 |
|---|---|---|---|
| 12 | XIII | 154.48 | 41 |

COPOLYMER 13

420 g of a molar copolymer of maleic anhydride and diisobutene (isomer mixture of 80% of trimethyl-1-pentene and 20% of trimethyl-2-pentene) of molecular weight 2,500 are heated with 362 g of toluene and 122.6 g of amine XIII (cf. Table 1) at 60° C. for 4 hours. The toluene is then distilled off in a rotary evaporator at 80° C. under reduced pressure, and the melt is poured onto a metal sheet. 394 g of the total resin thus obtained are dissolved in 300 g of water and 192 g of 50% strength aqueous potassium hydroxide solution to give a solution having a solids content of 23%. The K value of the copolymer (measured on the sodium salt at pH 7.5) is 15.

APPLICATION EXAMPLES

The above-described copolymers 1 to 13 were tested in the following liquid detergent formulations A and B:

| | |
|---|---|
| A. | 15% of a $C_{13}$-oxo alcohol + 8 mol of EO |
| | 15% of a $C_{13}/C_{15}$-oxo alcohol + 7 mol of EO |
| | 2% of polypropylene glycol (MW 600) |
| | 4% of polymer (100%) |
| | water to 100% |
| B. | 20% of a $C_{13}$-oxo alcohol + 7 mol of EO |
| | 10% of sodium dodecylbenzenesulfonate 50% |
| | 10% of coconut fatty acid |
| | 5% of triethanolamine |
| | 4% of polymer (100%) |
| | water to 100% |

In the case of comparative examples carried out without polymers, the amount of water was increased compared with the examples.

The primary detergency was determined under the following conditions:

| | |
|---|---|
| Soil removal, whiteness | % reflectance |
| Washing machine simulator | Launder-O-meter |
| Wash temperature | 60° C. |
| Water hardness | 3 mmol of $Ca^{2+}/1$ = 16.8° of German hardness |
| Ratio of Ca: Mg | 3:2 |
| Washing time | 30 minutes |
| Number of wash cycles: | 1 |
| Detergent concentration | 6 g of detergent composition per liter |
| Liquor ratio | 25:1 |
| Fabrics | WFK[1] 20 D (polyester/cotton) EMPA[2] 104 (polyester/cotton) |
| Whiteness measurement in Elrepho in % reflectance | |
| Whiteness of unwashed fabrics: | |
| WFK 20 D | 40.5 |
| EMPA 104 | 13 |

[1]WFK = Waschereiforschung Krefeld, West Germany
[2]EMPA = Eidgenossisches Materialprufamt, St. Gallen, Switzerland Secondary detergency, which is a measure of graryness inhibition on the fabric, was determined as follows:

| | |
|---|---|
| Washing machine simulator | Launder-O-meter |
| Wash temperature | 60° C. |
| Water hardness | 3 mmol of $Ca^{2+}/1$ = 18° of German hardness |
| Ratio of Ca: Mg | 3:2 |
| Washing time | 30 minutes |
| Number of wash cycles: | 1 |
| Detergent concentration | 6 g of detergent composition per litre |
| Liquor ratio | 14:1 |
| Fabric | cotton/polyester fabric, polyester fabric, WFK soiled fabric (replaced after every wash) |
| Whiteness measurement in Elrepho in % reflectance | |
| Whiteness of unwashed fabric: | |
| Cotton/polyester | 72 |
| Polyester | 74 |

The stability of each liquid detergent formulation is shown in Table 2 and the primary detergency and secondary detergency performances obtainable with these formulations are shown in Table 3.

TABLE 2

| | | | Stability at room temperature (23° C.) | | | | | |
|---|---|---|---|---|---|---|---|---|
| | | | Formulation A after | | | Formulation B after | | |
| | Copolymer | % of copolymer in liquid detergent | 1 day | 1 week | 4 weeks | 1 day | 1 week | 4 weeks |
| Example No. | | | | | | | | |
| 1 | Copolymer 1 | 4 | + | + | + | + | + | + |
| 2 | Copolymer 2 | 4 | + | + | + | + | + | + |
| 3 | Copolymer 3 | 4 | + | + | + | + | + | + |
| 4 | Copolymer 4 | 4 | + | + | + | + | + | + |
| 5 | Copolymer 5 | 4 | + | + | + | + | + | + |
| 6 | Copolymer 6 | 4 | + | + | + | + | + | + |
| 7 | Copolymer 7 | 4 | + | + | + | + | + | + |
| 8 | Copolymer 8 | 4 | + | + | + | + | + | + |
| 9 | Copolymer 9 | 4 | + | + | + | + | + | + |
| 10 | Copolymer 10 | 4 | + | + | + | + | + | + |
| 11 | Copolymer 11 | 4 | + | + | + | + | + | + |
| 12 | Copolymer 12 | 4 | + | + | + | + | + | + |
| 13 | Copolymer 13 | 4 | + | + | + | + | + | + |
| Comparative | | | | | | | | |

TABLE 2-continued

| Example No. | Copolymer | % of copolymer in liquid detergent | Stability at room temperature (23° C.) Formulation A after 1 day | 1 week | 4 weeks | Formulation B after 1 day | 1 week | 4 weeks |
|---|---|---|---|---|---|---|---|---|
| 1 | Without | 0 | + | + | + | + | + | + |
| 2 | Copolymer of acrylic acid and maleic acid, molecular weight, 70,000 | 4 | – | – | – | – | – | – |

+ = stable
– = unstable

TABLE 3

| Primary detergency (soil removal) Example No. | Copolymer | % of copolymer in liquid detergent | Primary detergency - whiteness - % reflectance Formulation A WFK 20 D | EMPA 104 | Formulation B WFK 20 D | EMPA 104 |
|---|---|---|---|---|---|---|
| 1 | Copolymer 1 | 4 | 57.0 | 26.0 | 58.2 | 24.3 |
| 2 | Copolymer 2 | 4 | 56.0 | 27.0 | 56.0 | 24.5 |
| 3 | Copolymer 3 | 4 | 58.2 | 27.5 | 56.5 | 24.5 |
| 4 | Copolymer 4 | 4 | 55.5 | 27.3 | 56.2 | 25.5 |
| 5 | Copolymer 5 | 4 | 54.5 | 27.5 | 57.5 | 26.0 |
| 6 | Copolymer 6 | 4 | 55.5 | 26.0 | 55.5 | 24.5 |
| 7 | Copolymer 7 | 4 | 58.0 | 26.5 | 56.0 | 25.0 |
| 8 | Copolymer 8 | 4 | 60.4 | 27.5 | 57.0 | 27.0 |
| 9 | Copolymer 9 | 4 | 57.0 | 26.3 | 56.3 | 25.5 |
| 10 | Copolymer 10 | 4 | 58.5 | 26.5 | 57.5 | 26.3 |
| 11 | Copolymer 11 | 4 | 57.3 | 27.0 | 54.5 | 24.8 |
| 12 | Copolymer 12 | 4 | 58.2 | 27.5 | 55.3 | 25.5 |
| 13 | Copolymer 13 | 4 | 59.0 | 26.5 | 56.5 | 26.2 |
| Comparative Example | — | — | 52.5 | 25.3 | 54.0 | 23.5 |

| Secondary detergency (soil antiredeposition) Example No. | Copolymer | % of copolymer in liquid detergent | Secondary detergency - % reflectance Formulation A Co/PES* | PES | Formulation B Co/PES | PES |
|---|---|---|---|---|---|---|
| 1 | Copolymer 1 | 4 | 70.5 | 66.5 | 59.5 | 50.0 |
| 2 | Copolymer 2 | 4 | 71.5 | 65.5 | 60.0 | 53.5 |
| 3 | Copolymer 3 | 4 | 72.0 | 66.0 | 61.5 | 53.0 |
| 4 | Copolymer 4 | 4 | 69.5 | 65.3 | 60.5 | 52.5 |
| 5 | Copolymer 5 | 4 | 69.0 | 54.5 | 59.3 | 50.5 |
| 6 | Copolymer 6 | 4 | 70.0 | 63.8 | 59.5 | 50.0 |
| 7 | Copolymer 7 | 4 | 71.0 | 64.0 | 60.0 | 51.5 |
| 8 | Copolymer 8 | 4 | 70.5 | 64.0 | 61.5 | 52.3 |
| 9 | Copolymer 9 | 4 | 71.0 | 66.5 | 60.5 | 52.5 |
| 10 | Copolymer 10 | 4 | 69.5 | 67.0 | 59.8 | 51.0 |
| 11 | Copolymer 11 | 4 | 70.5 | 65.3 | 59.0 | 49.0 |
| 12 | Copolymer 12 | 4 | 70.5 | 66.0 | 59.5 | 51.5 |
| 13 | Copolymer 13 | 4 | 69.2 | 65.5 | 60.3 | 52.5 |
| Comparative Example | — | — | 68.0 | 62.0 | 58.0 | 47.5 |

*Co = cotton
PES = polyester

We claim:

1. A liquid detergent formulation, containing as essential constituents (1) one or more anionic surfactants, one or more non-ionic surfactants or a mixture thereof, (2) 0.1–20% by weight of a copolymer containing as essential constituents (a) 50–99 mol % of units of a monoethylenically unsaturated $C_3$–$C_8$-monocarboxylic acid, a monoethylenically unsaturated $C_4$–$C_8$-dicarboxylic acid, a half ester of a monoethylenically unsaturated $C_4$–$C_8$-dicarboxylic acid, an ester of a monoethylenically unsaturated $C_3$–$C_8$-monocarboxylic acid, a $C_2$–$C_{30}$-olefin, styrene, a $C_1$–$C_3$-alkylstyrene, a $C_1$–$C_{28}$-alkyl vinyl ether, a vinyl ester of a saturated $C_1$–$C_8$-monocarboxylic acid or a mixture thereof and (b) 50–1 mol % of units of an amide of a monoethylenically unsaturated $C_3$–$C_8$-carboxylic acid where the amide groups have the structure

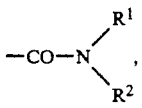

where $R^1$ is $$R-O-(\underset{R^3}{CH}-\underset{R^4}{CH}-O)_{n-1}-\underset{R^3}{CH}-\underset{R^4}{CH}-,$$

$R^3$ and $R^4$ are each H, $CH_3$ or $C_2H_5$,
R is $C_1$–$C_{28}$-alkyl,
n is from 2 to 100 and
$R^2$ is H or $R^1$, as copolymerized units, and has a K value of from 8 to 200 (determined by the method of H. Fikentscher in aqueous solution at 25° C., pH 7.5 and a polymer concentration of 1% by weight), or a salt thereof and (3) water.

2. A liquid detergent formulation as claimed in claim 1, wherein the copolymer contains as essential constituents of component (a) a mixture of units of a monoethylenically unsaturated $C_4$–$C_8$-dicarboxylic acid with a half ester of a monoethylenically unsaturated $C_4$–$C_8$-dicarboxylic acid, an ester of a monoethylenically unsaturated $C_3$–$C_8$-monocarboxylic acid, a $C_2$–$C_{30}$-olefin, styrene, a $C_1$–$C_3$-alkylstyrene, a $C_1$–$C_{28}$-alkyl vinyl ether, a vinyl ester of a saturated $C_1$–$C_8$-monocarboxylic acid, a monoethylenically unsaturated $C_3$–$C_8$-monocarboxylic acid, or a salt thereof, as copolymerized units.

3. A liquid detergent formulation as claimed in claim 1, wherein the copolymer contains as essential constitutuents of component (a) a mixture of units of maleic acid or itaconic acid with units of a half ester of a monoethylenically unsaturated $C_4$–$C_8$-dicarboxylic acid, an ester of a monoethylenically unsaturated $C_3$–$C_8$-monocarboxylic acid, a $C_2$–$C_{30}$-olefin, styrene, a $C_1$–$C_3$-alkylstyrene, a $C_1$–$C_{28}$-alkyl vinyl ether, a vinyl ester of a saturated $C_1$–$C_8$-monocarboxylic acid, a monoethylenically unsaturated $C_3$–$C_8$-monocarboxylic acid, or a salt, and (b) 50–1 mol % of units of an amide of a monoethylenically unsaturated $C_3$–$C_8$-carboxylic acid where the amide groups have the structure $$-CO-N\begin{matrix}R^1\\R^2\end{matrix},$$

where
$R^1$ is $R-O-(\underset{R^3}{CH}-\underset{R^4}{CH}-O)_{n-1}-\underset{R^3}{CH}-\underset{R^4}{CH}-$,
$R^3$ and $R^4$ are each H, $CH_3$, $C_2H_5$,
R is $C_1$–$C_{28}$-alkyl,
n is 2–100 and
$R^2$ is H or $R^1$ as copolymerized units.

4. A liquid detergent formulation as claimed in claim 1, wherein the copolymer is obtainable by copolymerizing (a) a mixture of an anhydride of a monoethylenically unsaturated $C_4$–$C_8$-dicarboxylic acid with a half ester of a monoethylenically unsaturated $C_4$–$C_8$-dicarboxylic acid, an ester of a monoethylenically unsaturated $C_3$–$C_8$-monocarboxylic acid, a $C_2$–$C_{30}$-olefin, styrene, a $C_1$–$C_3$-alkylstyrene, a $C_1$–$C_{28}$-alkyl vinyl ether, a vinyl ester of a saturated $C_1$–$C_8$-monocarboxylic acid, a monoethylenically unsaturated $C_3$–$C_8$-monocarboxylic acid, or a salt thereof, with a compound of component (b) in an inert organic solvent in the presence of a polymerization initiator and hydrolyzing the anhydride groups of the copolymer.

5. A liquid detergent formulation as claimed in claim 1, wherein the copolymer is obtainable by copolymerizing (a) a $C_3$–$C_8$-monoethylenically unsaturated monocarboxylic acid, a monoethylenically unsaturated $C_4$–$C_8$-dicarboxylic acid or a vinyl ester of a saturated $C_1$–$C_8$-carboxylic acid with a compound of component (b) in aqueous solution in the presence of a polymerization initiator.

6. A liquid detergent formulation of claim 1 wherein:

(a) is selected from one or more constituents selected from the group consisting of maleic acid, itaconic acid, acrylic acid, methacrylic acid and mixtures of 2,4,4-trimethyl-1-pentene and 2,4,4-trimethyl-2-pentene.

7. A liquid detergent formulation of claim 1 wherein:

(a) is selected from the group consisting of a $C_3$–$C_8$-monoethylenically unsaturated monocarboxylic acid, a monoethylenically unsaturated $C_4$–$C_8$-dicarboxylic acid and a vinyl ester of a saturated $C_1$–$C_8$-monocarboxylic acid; and (b) is selected from the group consisting of acrylamide, methacrylamide, maleic acid monoamide, maleic acid diamide, itaconic acid monoamide, and itaconic acid diamide, wherein the amide groups have the structure—$CONR^1R^2$ wherein $R^1$ is $R-O-(CH_2CH_2-O)_{4-30}-CH_2CH_2-$, wherein R is $C_1$–$C_{18}$ alkyl; and $R^2$ is selected from the group consisting of H and $R^1$.

* * * * *